US005910032A

United States Patent [19]

Gruenwald et al.

[11] Patent Number: 5,910,032

[45] Date of Patent: Jun. 8, 1999

[54] MARINE PROPULSION SYSTEM

[75] Inventors: David J. Gruenwald, Butte des Morts; James D. Gruenwald, Hartford, both of Wis.

[73] Assignee: Brunswick Corporation, Lake Forest, Ill.

[21] Appl. No.: 08/954,093

[22] Filed: Oct. 14, 1997

[51] Int. Cl.[6] ..... B63H 11/00

[52] U.S. Cl. ..... 440/38; 440/47

[58] Field of Search ..... 440/38–43, 46, 440/47

[56] References Cited

U.S. PATENT DOCUMENTS

| | | | |
|---|---|---|---|
| Re. 33,165 | 2/1990 | Whitehead | 440/69 |
| 3,263,643 | 8/1966 | Tattersall . | |
| 3,589,325 | 6/1971 | Tatersall . | |
| 3,590,766 | 7/1971 | Jackson | 440/38 |
| 3,598,080 | 8/1971 | Shields . | |
| 3,982,497 | 9/1976 | Caron . | |
| 4,088,091 | 5/1978 | Smith . | |
| 5,472,359 | 12/1995 | Allbright, Jr. et al. | 440/38 |
| 5,577,941 | 11/1996 | Chartier | 440/46 |
| 5,679,035 | 10/1997 | Jordan | 440/47 |

FOREIGN PATENT DOCUMENTS

| | | | |
|---|---|---|---|
| 93/09024 | 5/1993 | WIPO | 440/47 |

OTHER PUBLICATIONS

Water jet Propulsion Latest Developments published by Royal Institution of Naval Architects; presented in London on Dec. 1, 1994; authors John G. Stricker, Alan J. Becnel and John G. Purnell.

Report SIT–DL–83–9–2362 dated Aug. 1983 by the Stevens Institute of Technology for the Defense Logistics Agency of the Defense Technical Information Center entitled "Model Test of a Water jet Propulsion System for High Speed Amphibians" by F. Thomas Korsmeyer.

Report SIT–DL–85–9–2518 published in Mar. 1985 by the Stevens Institute of Technology for the Defense Logistics Agency of the Defense Technical Information Center entitled "Design Procedures for Low Speed Water Jets Suitable for Application in Amphibious Vehicles" written by John K. Roper.

*Primary Examiner*—Jesus D. Sotelo

*Attorney, Agent, or Firm*—William D. Lanyi

[57] ABSTRACT

A marine propulsion system, incorporating a jet pump, provides improved mass flow through the pump by utilizing an inlet opening which initially diverges to a transition point in front of an impeller and then diverges from the transition point past the impeller region to the outlet opening of the pump. Significantly increased flow rates per horsepower are achieved by reducing the normal restrictions caused by the inlet and outlet openings of known pumps. A transmission is provided to connect the output shaft of an engine to the drive shaft of the impeller. Either a V-drive or a torpedo-type gear housing can be employed.

20 Claims, 8 Drawing Sheets

MARINE PROPULSION SYSTEM

BACKGROUND OF THE INVENTION

1. Field of the Invention

The present invention is generally related to an improved marine propulsion system and, more specifically, to a marine propulsion system that utilizes a jet pump having a significantly improved flow rate which is achieved by certain advantageous configurations of its inlet and outlet structures.

2. Description of the Prior Art

Most marine propulsion systems utilize either an open propeller configuration or ajet drive configuration (i.e. a water jet). Open propellers are used with outboard, stem drive, and inboard systems. Jet drives or jet pumps, which incorporate a shrouded impeller, are typically used in jet boats, personal watercraft, and certain outboard motors that are equipped with a jet pump in place of an open propeller. Both the open propeller system and the jet pump system are well-known to those skilled in the art.

Both types of marine propulsion systems exhibit certain advantages and certain disadvantages. In a typical open propeller system, the propeller extends downward below the hull of a boat and damage can be caused if the propeller strikes a submerged object. Jet drives do not usually exhibit this disadvantage but typically are less efficient in operation and, when equipped with similarly sized engines, typically do not achieve the same maximum speed as an open propeller system.

In addition to having a lower operating efficiency and a lower maximum speed, jet drives known to those skilled in the art also exhibit certain disadvantageous spatial requirements. Most applications of jet drives require the engine to be placed in front of the pump. This utilizes valuable space in the central portion of the boat that could otherwise be used for seating or storage.

The limitation on the maximum speed for most jet drives is caused by limited water flow through the pump. As a result, to achieve a performance similar to an open propeller system, larger and more powerful engines must be used with jet drives. This, in turn, increases the cost of the propulsion system because the more expensive, higher horsepower engines are needed to achieve similar results to open propeller systems with much smaller engines.

Another difficulty that exists with most known jet drive propulsion systems is that the steering capability is severely limited under certain circumstances. Watercraft with jet drive propulsion systems can be stopped in two ways. First, the speed of the engine can be reduced by a manual throttle selection to slow the engine and allow the speed of the watercraft to decrease as a result of the friction between the hull and the surrounding water. In addition, certain jet propulsion systems are provided with a reverse gate which can be lowered behind the outlet to redirect the water and, in some cases, to create a reverse thrust to more rapidly slow the watercraft. This gate is referred to as a "bucket" or "clam shell" and is generally well-known to those skilled in the art.

When the engine of a jet propulsion system is decelerated, as during some braking maneuvers, the flow of water from the outlet is significantly reduced and, as a result, the steering capabilities of the watercraft are severely restricted. When the gate is used for braking purposes, the resulting effect on steering can be opposite to that which is normally expected. As a result, most watercraft with jet propulsion systems have little or no braking capability and, even when this capability is provided, the ability to properly steer the watercraft is severely compromised.

U.S. Pat. No. 3,982,497, which issued to Caron on Sep. 28, 1976, describes a jet-propelled powerboat. The powerboat has a tunnel drive and a propeller which is external to the boat. The boat described in this patent is fiberglass with the front rounded to prevent cracking when docking or otherwise striking an object. The cockpit is surrounded with a raised deck on all sides, including the rear, and also by rails on the inner portion of the deck sides. This patent shows in its FIGS. 3 and 5 views of the inlet opening of a jet pump which are helpful in comparison to the present invention described below.

U.S. Pat. No. 5,577,941, which issued to Chartier on Nov. 26, 1996, discloses a marine jet drive weed grate. The weed grate has a plurality of cantilever tines extending rearwardly along the water intake. They have suspended aft end tips spaced from the aft end of the water intake such that weeds and debris may slide rearwardly along and then off of the cantilever tines without clogging. The weed grate is shaped to cover the inlet opening of a jet drive propulsion system and is thus illustrative of the prior art.

A document entitled "Waterjet Propulsion Latest Developments," published by The Royal Institution of Naval Architects and presented at an International Symposium in London on Dec. 1, 1994, discusses several important factors in the development of waterjet systems. In that paper, its authors, John G. Stricker, Alan J. Becnel, and John G. Purnell, describe several water jet designs including an advanced amphibious assault vehicle (AAAV). A propulsion system demonstrator (PSD) is described and illustrated in the first figure of the paper. In that figure, a water jet is shown driven by a hydraulic motor which rotates an impeller. The outlet opening of the water jet appears to have a diameter approximately equal to the diameter of the impeller blades. Steering of a watercraft is accomplished by providing two or more water jets and using variations in the thrust of the water jets to maneuver the vehicle. In the paper no rudder or nozzle is discussed. The propulsor described in this document is intended for low speed operation with heavy loads. For example, the tested prototype described in the paper fed a diameter of 16.1 inches and a power of approximately 500 horsepower at 16 miles per hour.

Report SIT-DL-83-9-2362, dated August 1983, by the Stevens Institute of Technology for the Defense Logistics Agency of the Defense Technical Information Center of the Department of Defense is titled "Model Test of a Waterjet Propulsion System for High Speed Amphibians" by F. Thomas Korsmeyer. The report describes a water jet that was designed for evaluation in a 15 foot manned test craft. The goals of the model experiment were to determine the resistance of the test craft, to characterize the model propulsion system, and to use the characterization to reflect on the merits of the water jet design method used for the manned test craft.

Report SIT-DL-85-9-2518, published in March 1985 by the Stevens Institute of Technology for the Defense Logistics Agency of the Defense Technical Information Center of the Department of Defense is titled "Design Procedures for Low Speed Waterjets Suitable for Application in Amphibious Vehicles" and was written by John K. Roper. The paper describes a manned test craft that was constructed in order to evaluate a 14 inch diameter water jet unit at vehicle speeds up to 25 miles per hour in water. Among other things, the report concluded that a 1.0 area ratio impeller shows evidence of cavitation inception under certain circumstances, whereas two larger area impellers show no such evidence under certain condition. The inlet opening of the device was 19.5 inches and was selected to minimize the overall length of the system since trial results showed no consistent penalty associated with the shorter inlet length.

U.S. Pat. No. 5,472,359, which issued to Allbright Jr. et. al. on Dec. 5, 1995, describes an enclosed shaft system for a marine jet propulsion drive. The system provides an improved lubrication and coolant system over current designs. The preferred embodiment contemplates the utilization of an enclosed shaft system wherein the drive propeller drives a portion of the water passing through the tunnel drive through a water intake. The water is filtered and directed to a fitting where a portion of the water is directed to the engine for cooling and the remaining water is directed to the base of the shaft housing. U.S. Pat. No. 5,472,359 shows a cross-sectional area of a water jet.

U.S. Pat. No. 3,263,643, which issued to Tattersall on Aug. 2, 1966, discloses a vehicle operable over water. The invention relates to systems that operate by taking in water, energizing it, and then expelling it. It relates specifically to vehicles known as Hovercraft by those skilled in the art.

U.S. Pat. No. 33,165, which was reissued to Whitehead on Feb. 13, 1990, describes a boat hull with a flow chamber. The hull has a two-stage flow chamber. The first stage chamber starts approximately amidships as a V-shaped fairing upward at a shallow angle and flattening out approximately halfway to the stern. The second stage flow chamber starts at the end of the forward flow chamber curving upward at a greater angle than the first stage and curving downward slightly at the stern.

U.S. Pat. No. 4,088,091, which issued to Smith on May 9, 1973, discloses a fin assembly for powerboats. The fin structure is intended for mounting in an opening in the hull of a powerboat having an elongated rectangular panel connected between the base edges of a pair of elongated fins. Each fin has a base edge, a leading edge, and a trailing edge. These are joined to the elongated rectangular panel to locate the pair of fins in substantially parallel alignment in order to form a channel adapted to receive a propeller and a propeller shaft therein with the propeller in proximity of the trailing edges. The trailing edge of each fin projects from one end of the base edge beyond the outer most extremities of the propeller received in the channel. A rudder may be attached to each trailing edge of the fins and a V-drive unit may be added to reverse the longitudinal direction of the transmission power trained between the propeller shaft and the engine within the hull.

U.S. Pat. No. 3,589,325, which issued to Tattersall on Jun. 29, 1971, describes a method and apparatus for steering a marine craft. The craft is fitted with a water jet propulsion unit having a rudder disposed adjacent the outlet of the unit so as to influence the direction taken by water discharged from the outlet. The rudder, besides being pivotal about an axis passing through the plane of its surface, is also rotatable about an axis passing through the outlet of the unit. When executing a turn, the rudder is not only pivoted to execute the turn but is also rotated, in the general direction of the turn, so as to create an upward component of force on the rudder which tends to cause the craft to bank into the turn.

U.S. Pat. No. 3,598,080, which issued to Shields on Aug. 10, 1971, describes a monoshaft propeller water jet. The propulsion system of the water jet provides a semi-submerged super cavitating propeller rotating coaxially with water jet producing impellers mounted on the same shaft.

The United States patents described above are hereby explicitly incorporated by reference herein.

As described above, known pumps for jet propulsion systems exhibit significantly lower efficiencies of operation than equivalently sized open propeller systems. There are several reasons for this decreased operational capability. First, known jet pumps use outlet openings which are tapered and significantly smaller in diameter than the effective diameter of the impeller blades within the pump. This reduction in size at the outlet opening severely restricts the flow of water from the pump and increases the resistance to that flow of water. Typically, the reduced diameter of the outlet opening restricts the flow of water through the pump to a magnitude significantly less than that which the impeller could otherwise pump if the nozzle restriction did not exist. Another reason for the decreased operational efficiency of jet pumps is the restrictive configuration of the inlet opening. Simply stated, the impeller of the typical jet pump has the capability of driving a significantly higher quantity of water (i.e. mass flow) through the pump than can be efficiently drawn into and through the inlet opening toward the impeller and expelled through the outlet opening.

A third adverse effect on jet pump efficiency is the need for most known pumps to raise, or lift, water from the inlet to the location of the impeller. Energy must be expended to lift the water from the inlet opening to the height of the impeller which is typically located a significant distance from the bottom of the hull. This required work decreases the power that is available from the engine to propel the watercraft.

Another factor that reduces the fuel economy of most known jet drive propulsion systems is the fact that the engine is connected directly to the impeller and the impeller must therefore rotate continually even though the watercraft is not moving. In other words, as long as the engine is running, the impeller is rotating and attempting to force water through the pump even though that water is then merely redirected by a reversing bucket or clamshell in such a way as to prevent actual movement of the watercraft. This results in a significant waste of energy and a resulting decrease in fuel economy.

It would therefore be significantly beneficial if a marine propulsion system could be developed which utilizes a jet pump that does not exhibit the disadvantageous characteristics of lower operational efficiency, reduced maximum speed, limited acceleration capability, inconvenient spatial requirements within the watercraft, and steering difficulties during braking and reversing operations.

SUMMARY OF THE INVENTION

A marine propulsion system made in accordance with the present invention comprises a pump which has an inlet opening and an outlet opening. It also comprises an impeller disposed within the pump and attached to a drive shaft. The impeller has at least one blade attached thereto, and the impeller is rotatable about a central axis of the drive shaft to cause water to flow through the pump from the inlet opening to the outlet opening and thus provide a propulsive force on the marine propulsion system. The impeller has an effective diameter and the outlet opening has a diameter with a magnitude at least 70% of the magnitude of the effective diameter of the impeller, but less than 98% of the effective diameter of the impeller. The inlet opening has an effective cross-sectional area that diverges from a point at a leading edge of the inlet opening to a transition point which is located between the leading edge of the inlet opening and the impeller. The inlet's effective cross-sectional area converges from that transition point to the impeller.

The marine propulsion system made in accordance with the present invention also comprises a tubular rudder which is disposed proximate and aft of the outlet opening in order to provide a steering capability by directing a stream of water in a selectable direction as it flows through the pump in response to rotation of the impeller. The propulsion system of the present invention further comprises an engine having an output shaft which is rotatable in response to operation of the engine. The output shaft of the engine is connectable in torque transmitting relation with the drive shaft of the impeller.

A transmission can be connected between the output shaft of the engine and the drive shaft of the impeller. The transmission can comprise at least one forward gear and a neutral gear position which effectively disconnects the impeller drive shaft from the engine output shaft. The transmission can also comprise a first gear selection which rotates the drive shaft in a first rotational direction relative to the output shaft and a second gear selection which rotates the drive shaft in a second rotational direction relative to the engine output shaft in response to a manual selection. In other words, if the engine output shaft is rotating clockwise, the transmission can comprise two gear selections which cause the drive shaft to rotate either clockwise or counterclockwise, based on a manual selection.

The output shaft of the engine and the drive shaft of the impeller, in one embodiment of the present invention, are associated in a V-drive arrangement with the transmission disposed therebetween. Alternatively, the transmission can be disposed within the pump and proximate a centerline of the drive shaft. This embodiment utilizes a torpedo-shaped gear housing that is disposed within the conduit of the pump between the inlet opening and the outlet opening.

In order to achieve improved operational capabilities, the outlet opening of the jet drive can have a diameter with a magnitude which is 80%, 85%, 90% or more of the effective diameter of the impeller. It has been discovered that it is advantageous to limit the outlet opening size to a magnitude which is slightly less than 100% of the effective impeller diameter because of reasons relating to the fluid dynamics of the pump. However, it has also been determined that increasing the size of the outlet opening diameter improves performance of the pump up to 95% and possibly as great as 98% of the effective diameter of the impeller. These specific magnitudes are somewhat dependent on other features of the pump design, but could be determined empirically for specific applications.

An important distinction between the present invention and prior art jet drive systems is that the ratio of the mass flow rate of water through the pump, measured in pounds per second per horsepower of the engines is greater than 10.0 in a propulsion system made in accordance with the present invention. Under certain conditions, this ratio can be 12.0, 15.0, 18.0, 20.0 or greater. An increase in the ratio of the mass flow rate of water through the pump, to the horsepower of the engine, will increase the operational efficiency and the performance capabilities of the system if the inlet is designed to accept that increased flow rate.

Another distinguishing feature of the present invention is the size of its inlet opening relative to the impeller size. In order to define this relative size, a length of the opening is measured along the line which is parallel to its direction of travel from a leading edge of the opening to the impeller. This length of the opening magnitude is at least three times the magnitude of the effective diameter of the impeller. The precise dimensions used to define the ratio between the length of the inlet opening and the magnitude of the effective diameter of the impeller will be described in greater detail below. Improvement in certain embodiments of the present invention can be achieved when this ratio is increased so that the length of the opening has a magnitude which is at least four times the magnitude of the effective diameter of the impeller.

BRIEF DESCRIPTION OF THE DRAWINGS

The present invention will be more fully and completely understood from a reading of the description of the preferred embodiment in conjunction with the Figures, in which.

DESCRIPTION OF PREFERRED EMBODIMENT

Figure 1:
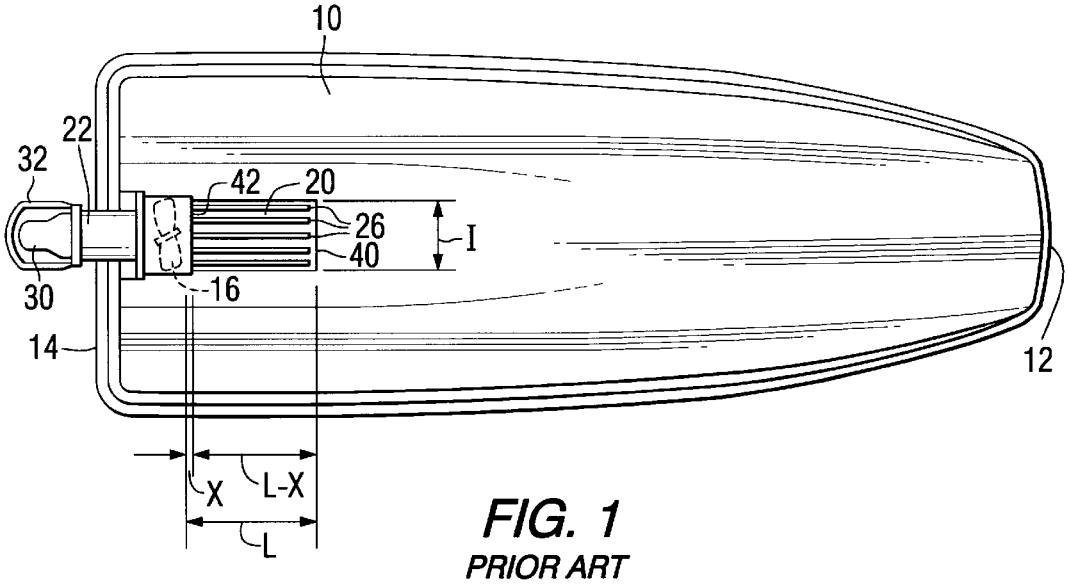
FIG. 1 PRIOR ART
FIGS. 1 and 2 show two views of a prior art jet pump.

Throughout the description of the preferred embodiment, like components will be identified by like reference numerals.

FIG. 1 shows a bottom view of the hull of a known watercraft which incorporates a jet pump propulsion system. The watercraft 10 has a bow portion 12 and a stem portion 14. The jet pump comprises an impeller 16, shown by dashed lines, disposed between an inlet opening 20 and an outlet opening 22. A plurality of tines 26 is used to provide a grate over the inlet opening 20 to prevent the passage of debris into the impeller region of the pump. Disposed behind the outlet opening 22 is a tubular rudder 30 which can be used to steer the watercraft. In addition, a bucket 32 is pivotally mounted to the pump structure to provide a braking function, neutral operation or a reverse function. The structure illustrated in FIG. 1 is described in detail and illustrated in U.S. Pat. No. 3,982,497, which is discussed above. The structure shown in FIG. 1 is well-known to those skilled in the art and is generally representative of the inlet opening 20 and outlet opening 22 shapes known in the prior art.

The illustration of FIG. 1 will be used to define certain dimensions that will be used below to describe certain specific features of the present invention. A dimension between a leading edge 40 of the inlet opening 20 and the leading edge of the impeller 16 is identified as length L in FIG. 1. The aft edge of the inlet opening 20, as viewed from below the watercraft 10, is identified by reference numeral 42 in FIG. 1. The distance between that aft edge 42 and the impeller 16 is identified in FIG. 1 as dimension X. As a result, the distance between the leading edge 40 and the trailing edge 42 of the inlet opening 20 is equal to the difference between the length L and dimension X.

The effective diameter of the impeller 16 is identified by dimension I in FIG. 1. Although the components in FIG. 1 are not explicitly dimensioned and are not necessarily drawn to scale, the watercraft and propulsion system illustrated in FIG. 1 will be used to define certain relationships between the identified dimensions. The relative sizes of the impeller 16 and the inlet opening 20 show that the length in FIG. 1, defined as L-X, is less than twice the magnitude of the effective diameter I of the impeller 16. The effective size of the inlet opening 20 can be discussed in terms of its relative size compared to the size of the impeller 16. In addition, its general shape from fore to aft can be described as being generally rectangular. The width of the inlet opening 20 is generally constant from fore to aft, neither diverging or converging.

Figure 2:
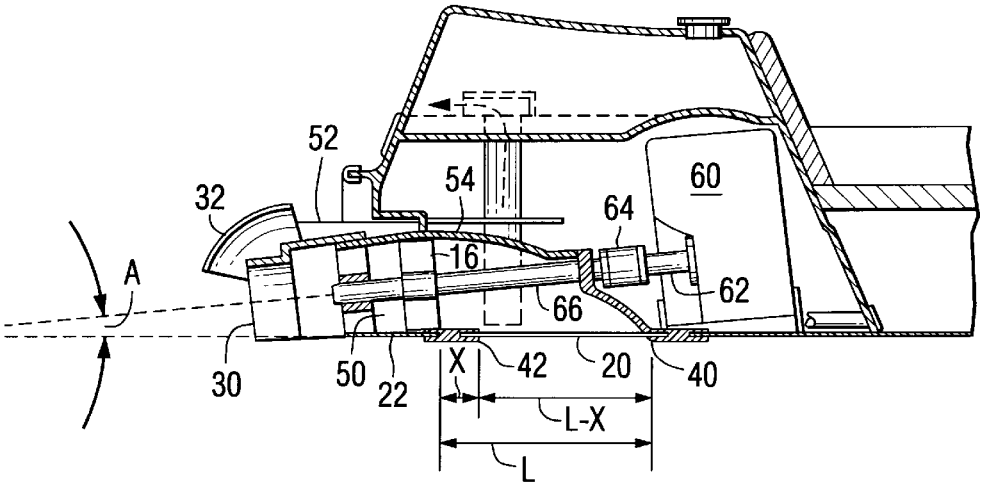
FIG. 2 PRIOR ART

FIG. 2 is a sectional view taking through the jet pump of the device described in detail in U.S. Pat. No. 3,982,497 and shown in FIG. 1. The inlet opening 20 is defined as the opening between the leading edge 40 and trailing edge 42 of the device shown in FIG. 1 which has a length of L-X. A stator 50 is disposed behind the impeller 16. The reversing bucket 32 and tubular rudder 30 are controlled by the devices identified by reference numerals 52 and 54, respectively. An engine 60 is used to provide the motive power to drive an output shaft 62. The output shaft 62 is connected, through a flexible coupling 64, to a drive shaft 66 connected directly to the impeller 16. When in operation, the output shaft 62 and drive shaft 66 operate to rotate the impeller 16 and draw water upwards into the inlet opening 20, past the impeller 16 and stator 50, through the outlet opening 22, and through the tubular rudder 30.

With continued reference to FIG. 2, it should be noted that angle A defines an angle between the bottom of the boat and the drive shaft 66 of the impeller 16. Angle A is necessitated by the location and size of the engine 60. In order to avoid the downward angle A shown in FIG. 2, the physical position of the impeller 16 would have to be raised relative to the bottom of the boat. As will be described in greater detail below, the magnitude and direction of angle A can be disadvantageous to the operation and design of watercraft.

Dimensions L, L-X, and X are also illustrated in FIG. 2. The total length L of the opening, measured between the leading edge 40 and the impeller 16, is always greater than or equal to the actual effective size of the inlet opening 20, defined as L-X in FIGS. 1 and 2. The magnitude of dimension X can vary by design and can be very small in certain configurations.

FIGS. 1 and 2 show a watercraft and marine propulsion system that is well-known to those skilled in the art and which employs many design choices that are common in jet pump drives. With respect to FIGS. 1 and 2, various dimensions are identified with respect to the relative sizes of various components and portions of the marine propulsion system. These dimensions will be used consistently throughout the description of the preferred embodiment below in order to allow the present invention to be completely and fairly compared to the prior art.

Figure 3:
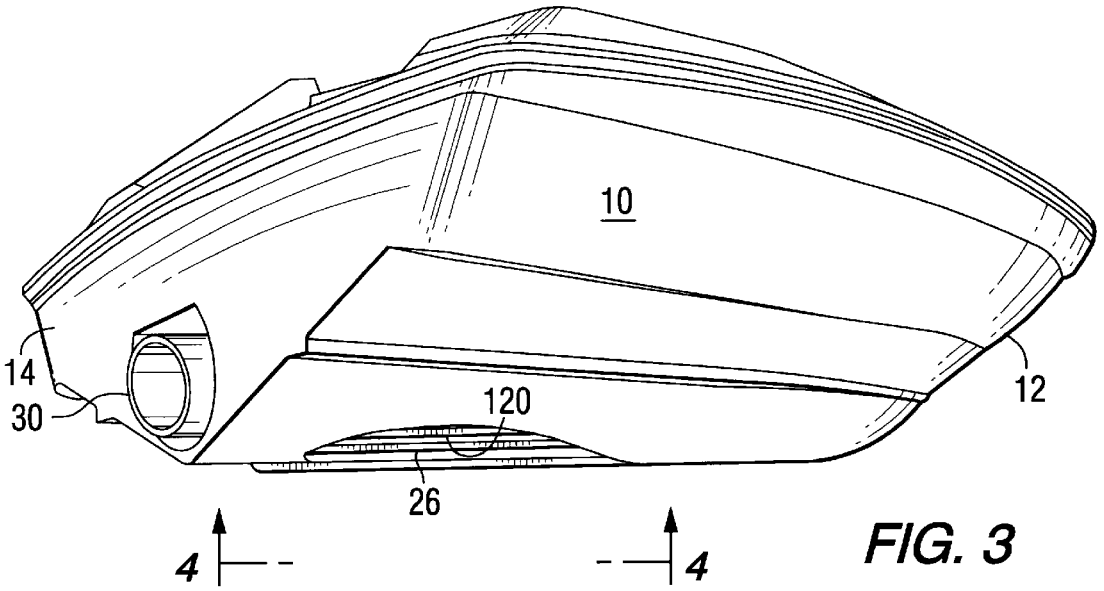
FIGS. 3 and 4 show two views of the present invention employed with a boat hull.

FIG. 3 illustrates a boat 10 incorporating a marine propulsion system made in accordance with the present invention. The boat has a stern 14 and a bow 12. A tubular rudder 30 is shown extending through an opening formed in the stern 14. An inlet opening 120 is formed in the bottom of the boat and is provided with a plurality of tines to prevent debris from being drawn into the pump.

Figure 4:
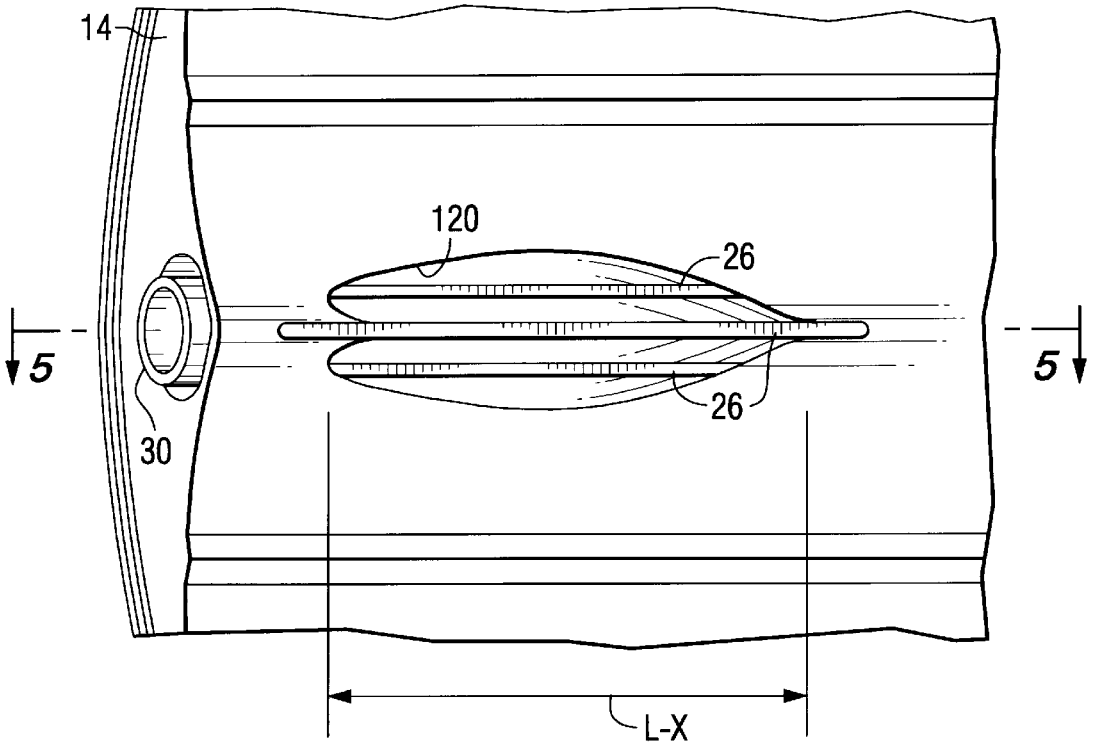

FIG. 4 is a bottom view of the watercraft shown in FIG. 3, with a more revealing representation of the inlet opening 120. The inlet opening 120 is shown with a plurality of tines 26 extending across the length of the opening to prevent debris from being drawn into the impeller. The significant difference in the shape of opening 120 in FIG. 4 and the shape of the prior art opening 20 in FIG. 1 can readily be seen. The inlet opening 120 of the present invention is generally tear drop shaped with a pointed leading edge and an opening through the hull of the boat which first diverges from the leading edge to a transition point and then converges from the transition point to the impeller. The opening 20 known in the prior art, on the other hand, is generally rectangular without this divergence and convergence. Another distinction between the present invention and the prior art, which will be described in greater detail below, is the absence of the bucket 32 located near the tubular rudder 30.

Figure 5:
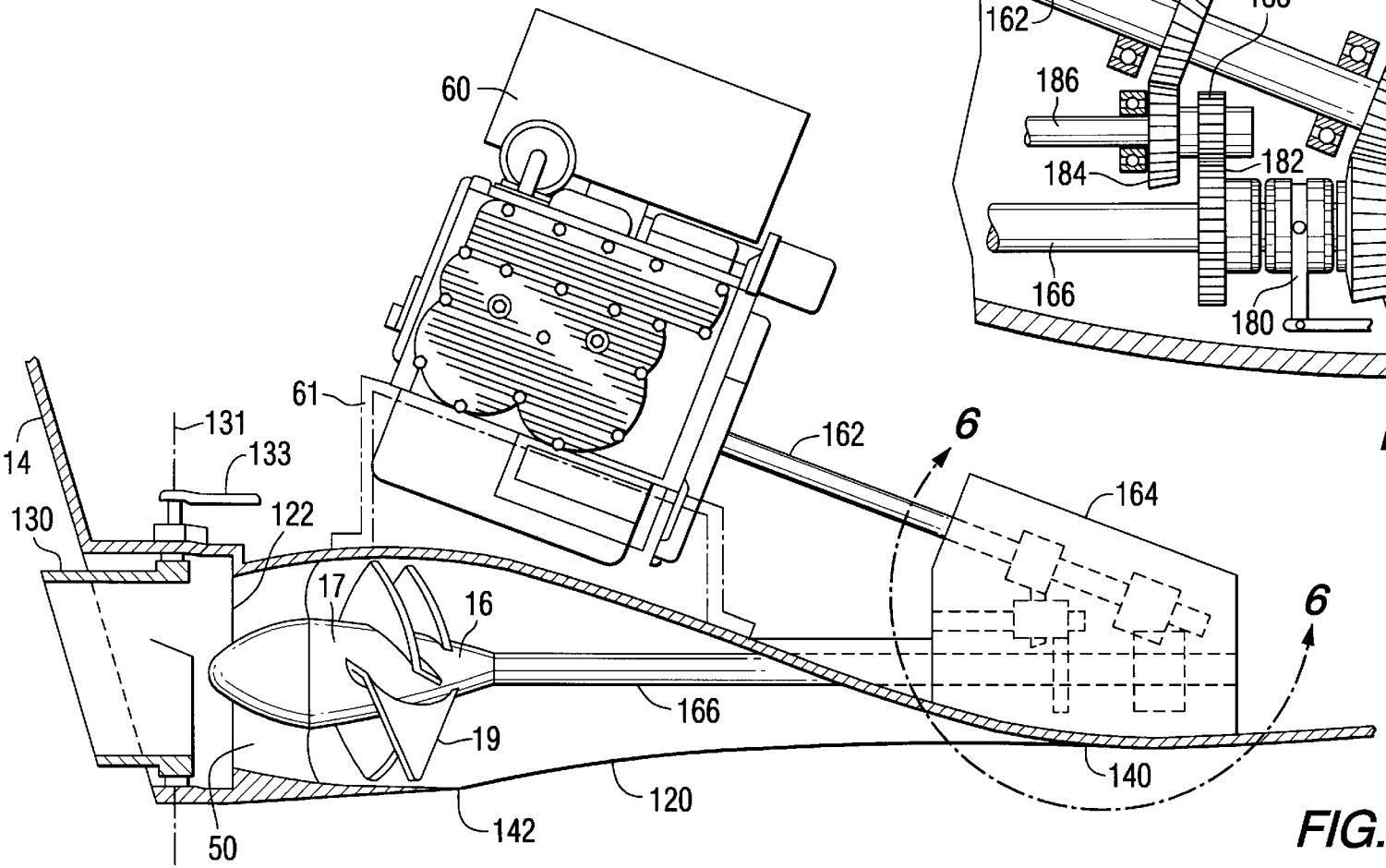
FIG. 5 shows a section view of one embodiment of the present invention.

FIG. 5 is a sectional view taken through the illustration of FIG. 4 to show the internal components of the marine propulsion system of the present invention. An engine 60 is attached to the bottom of the watercraft by an appropriate bracket 61 and the engine drives an output shaft 162. A transmission 164, which will be described in greater detail below in conjunction with FIG. 6, connects the output shaft 162 in torque transmitting relation with the drive shaft 166 which is connected to the impeller 16. The impeller 16 comprises a hub 17 with a plurality of blades 19 attached thereto. The drive shaft 166 passes through an opening formed in the bottom surface of the watercraft. A stator 50 is disposed aft of the impeller 16. The outlet opening 122 is shown at the aft edge of the stator 50. Typically, a bearing support for the drive shaft 166 is provided in the stator 50. The tubular rudder 130 is pivotally attached to the boat and rotatable about axis 131 by a control arm 133. The inlet opening 120, defined between the leading edge 140 and the trailing edge 142, will be described in greater detail below, in conjunction with the relevant dimensions L, L-X, X, and I.

Figure 6:
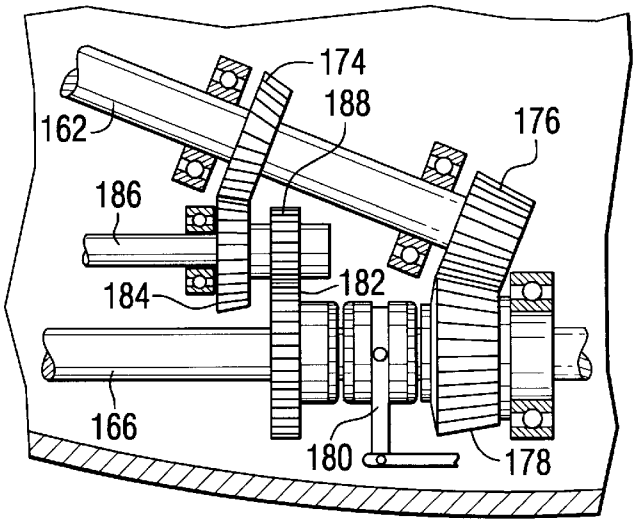
FIG. 6 is a detailed section view of the transmission portion of FIG. 5.

FIG. 6 is a detailed sectional view of FIG. 5, showing the transmission 164. In one embodiment of the present invention, the output shaft 162 and drive shaft 166 are arranged in a V-drive configuration as shown in FIG. 5. In that type of arrangement, the transmission 164 will be configured generally as illustrated in FIG. 6. The output shaft 162 is provided with bevel gears 174 and 176 which are located on the output shaft of the engine. Bevel gear 176 drives bevel gear 178, and bevel gear 174 drives bevel gear 184 on auxiliary shaft 186. Bevel gear 184 is coupled to a spur gear 188 which, in turn, drives spur gear 182 on impeller drive shaft 166. Bevel gear 178 is coupled drive shaft 166 by a coupling 180. Movement of the coupling 180 in a direction left and right in FIG. 6 engages either bevel gear 178 or spur gear 182 to the drive shaft 166 or, alternatively, places the transmission in a neutral setting if the coupling 180 is disconnected from both the bevel gear 178 or the spur gear 182.

Figure 7:
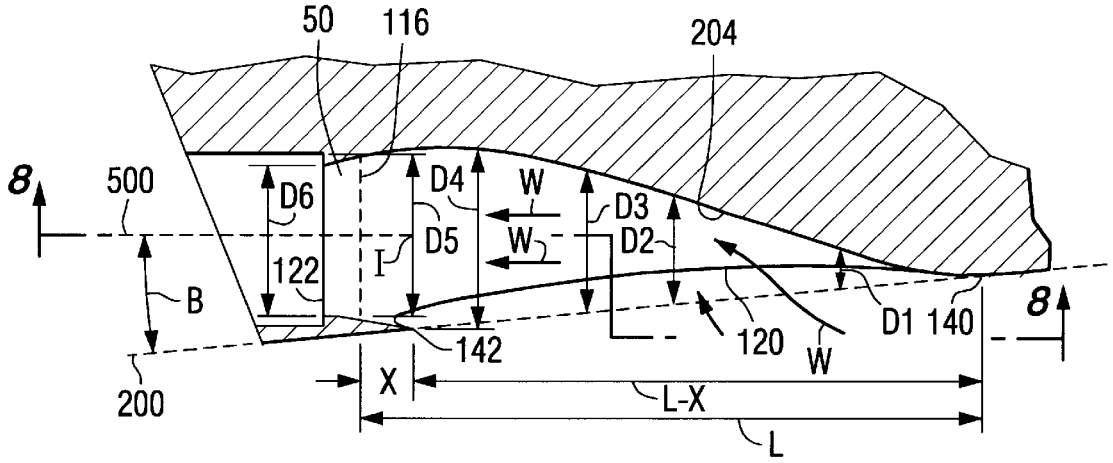
FIGS. 7 and 8 show two section views of the jet pump without the internal components in place.

FIG. 7 is a partial section view of the inlet opening, impeller housing, and outlet opening of the present invention shown in FIG. 5. The impeller has been removed from the illustration in order to allow the particular configuration of the inlet opening and outlet opening to be described in greater detail. As described above, the inlet opening 120 can be defined as having a length L measured between a leading edge 140 of the opening and a trailing edge 142 of the opening. Although the leading edge 140 is not, in reality, an actual edge in the normal sense of that term, it is defined by a point of tangency between the bottom of the boat and the inlet conduit. The flow of water, represented by arrow W, flows into the inlet opening 120 and toward the region where the impeller is located. Certain characteristics of the inlet opening are important in order to define the distinctions between the present invention and the prior art. For these purposes, a dashed line 200 is shown connected between the leading edge 140 and the trailing edge 142 of the inlet opening 120 and generally aligned with the bottom of the boat. Measured from line 200, several arrows, D1–D6, are used to indicate the distance between line 200 and the upper surface 204 of the pump conduit. These dimensions D1–D6 represent the gradually changing dimensions of the inlet opening taken in a direction from fore to aft. The first dimension D1 is near the leading edge 140 and is minimal. These dimensions increase from D1 to D2 and from D2 to D3. At the location identified by arrow D4 in FIG. 7, the dimension reaches a maximum magnitude. For purposes of this description, the location identified by arrow D4 is called a transition point. The inlet opening 120 diverges from the leading edge 140 to the transition point dimension D4. Although the rate of divergence changes slightly because of the shape of the upper surface 204 of the pump conduit, the magnitude of the dimension continues to increase from the leading edge 140 to the transition point D4. Transition point D4 is in front of the impeller location. At location D5, the diameter of the impeller is shaped to fit within the opening. That effective diameter, previously identified as dimension I, is located at a point aft of the transition point D4. In other words, the dimension of the inlet opening converges from the transition point D4 to the impeller. The effective diameter I of the impeller is less than the magnitude of dimension D4 at the transition point. This dimension continues to converge from the impeller to the outlet opening 122. Dashed line 116 is used to represent the general location of the impeller within the structure shown in FIG. 7. It can be the leading edge of the impeller, but this is not always necessary. The stator 50 is aft of the impeller location 116.

Figure 8:
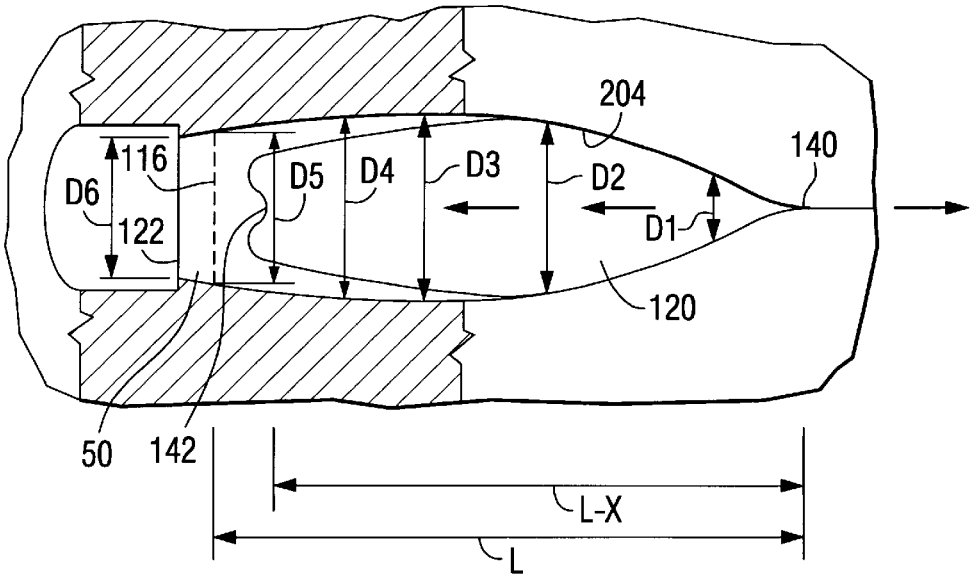

FIG. 8 is a section view of FIG. 7, taken along a staggered line as shown in FIG. 7. In FIG. 8, the general shape of the pump conduit is shown. It should be understood that the precise illustrated shape of the inlet is slightly affected by the line along which section 8 is taken in FIG. 7. The divergence of the dimensions D1, D2, D3 and D4 extends from the leading edge 140 to the transition point D4. Although not visually obvious in FIG. 8, it should be understood that the dimensions represented by the arrows continually diverge from the leading edge 140 to the transition point at arrow D4 and then converge from the transition point D4 to the location where the impeller is disposed. This gradual convergence continues from the transition point D4 to the outlet opening 122. In other words, dimension D6 is slightly less than dimension D5 which, in turn, is slightly less than dimension D4. In a preferred embodiment of the present invention, dimension D6 at the outlet opening 122 is at least 70% of the effective impeller diameter I at arrow D5. In fact, dimension D6 is used to significantly improve the operation of the pump by making it as large as possible relative to the impeller diameter I, but not quite being equal in dimension to the impeller diameter. In other words, the outlet opening 122 is provided with the dimension D6 that is at least 70% of the impeller diameter I, but less than approximately 96% to 98% of the effective impeller diameter I.

With respect to FIG. 7, another important physical parameter of the present invention can be seen. The effective impeller diameter I is significantly smaller than the magnitudes of lengths L and L-X. In fact, the length L is at least twice the magnitude of the effective impeller diameter I and, in certain preferred applications of the present invention, dimensions L and L-X are three or more times the magnitude of the effective impeller diameter I.

With respect to FIGS. 5, 7 and 8, the most distinguishing characteristic of the present invention can be simply described as having the inlet opening 120 and the outlet opening 122 being made as large as possible so that the flow restrictions caused at these openings is minimized. When this is done, the impeller is able to operate much more efficiently in moving water through the pump at much higher mass flow rates than would otherwise be possible with jet pumps made in accordance with the prior art.

Figure 9:
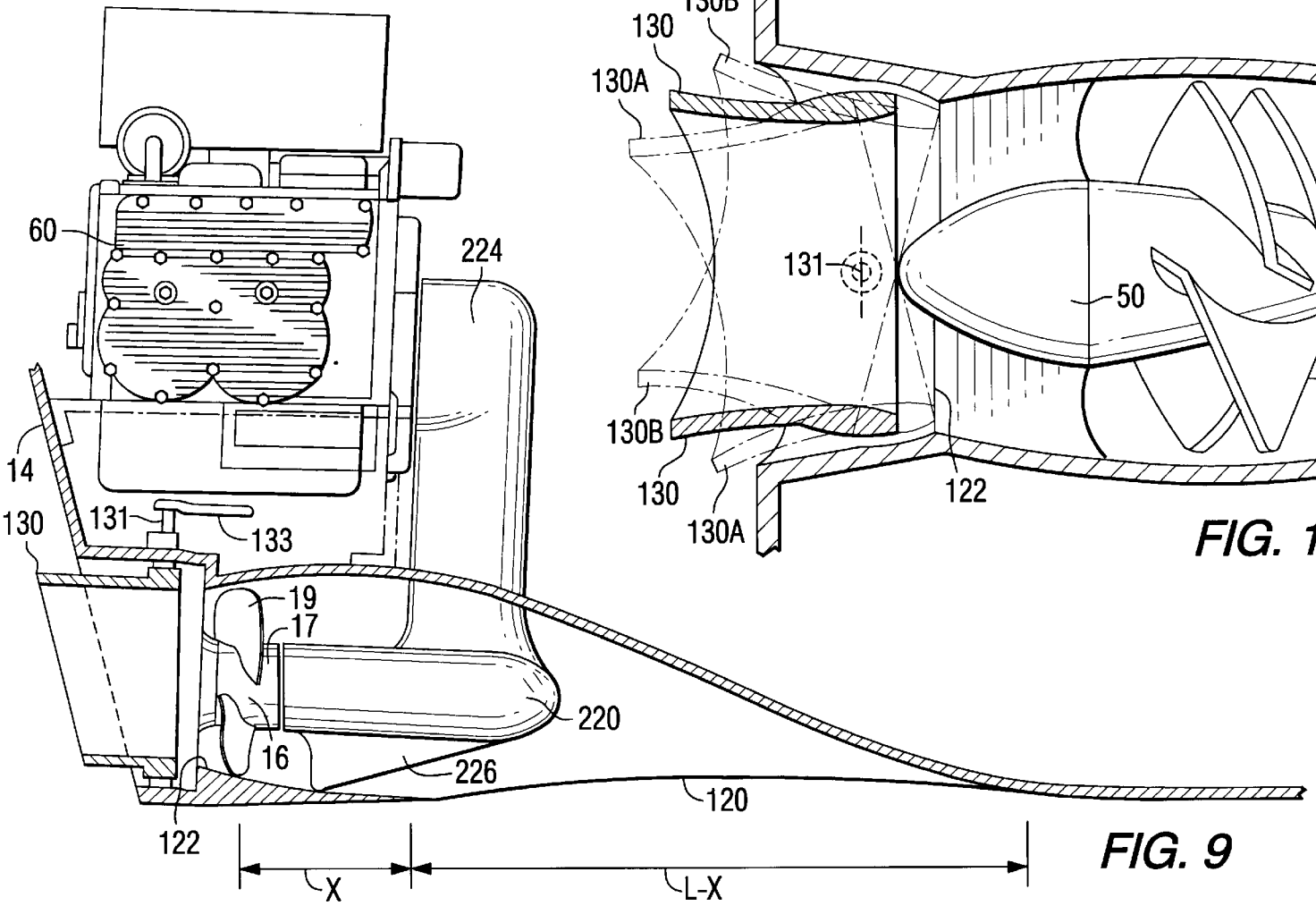
FIG. 9 shows a section view of an alternative embodiment of the present invention.

The present invention is described above, in conjunction with FIGS. 5 and 6, in an embodiment incorporating a V-drive arrangement. An alternative embodiment is shown in FIG. 9 where a housing disposes the transmission within a torpedo 220 and the transmission is disposed at a centerline of the impeller's drive shaft 166 (not shown in FIG. 9). The horizontal drive shaft and transmission are located within the gear housing, or torpedo 220. The drive shaft housing 224 is used to house the drive train and certain associated gears and bearings. The arrangement shown in FIG. 9 allows the engine 60 to be disposed at a slightly different location than that described above in conjunction with FIG. 5. However, all of the other elements of the present invention are similar to those described above. The skeg 226 and the torpedo 220 are located within the pump in the embodiment of FIG. 9 whereas the transmission 164 is contained at a separate location in the V-drive arrangement of FIG. 5. Other than the location of the various components, the embodiments shown in FIGS. 5 and 7 both incorporate all of the novel features of the present invention.

With continued reference to FIG. 9, dimensions L-X and X are shown for purposes of reference. The ratio of dimension L-X to the effective impeller diameter I is at least two to one and actually greater than four to one in the embodiments shown in FIGS. 5 and 7.

Figure 10:
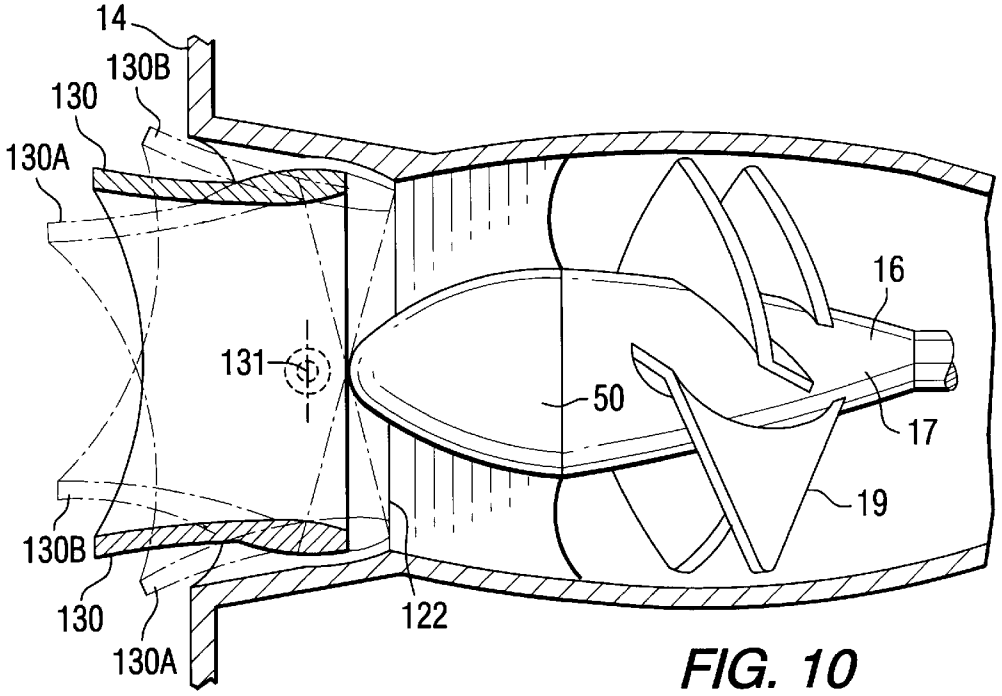
FIG. 10 shows a section view of the impeller, stator, and tubular rudder of the present invention.

FIG. 10 shows a sectional view of the impeller 16, stator 50 and tubular rudder 130. The tubular rudder is shown in a central position and two alternative side positions, 130A and 130B, which illustrate the range of travel of the tubular rudder 130 about centerline 131. The tubular rudder 130 can be used to steer the boat by directing the outflow of water in a preselected direction to create the appropriate force vectors to cause the boat to move left or right. One characteristic of the present invention, because of its large outlet opening 122, is the ability to also steer the boat when it is moving in a reverse direction and the impeller 16 is drawing water into the outlet opening 122 and expelling it out of the inlet opening 120. Although not as efficient as a forward operation of the present invention, the enlarged outlet opening 122 allows the boat to be driven in a reverse direction and steered in a mode that most drivers consider to be natural, like an automobile.

Figure 11:
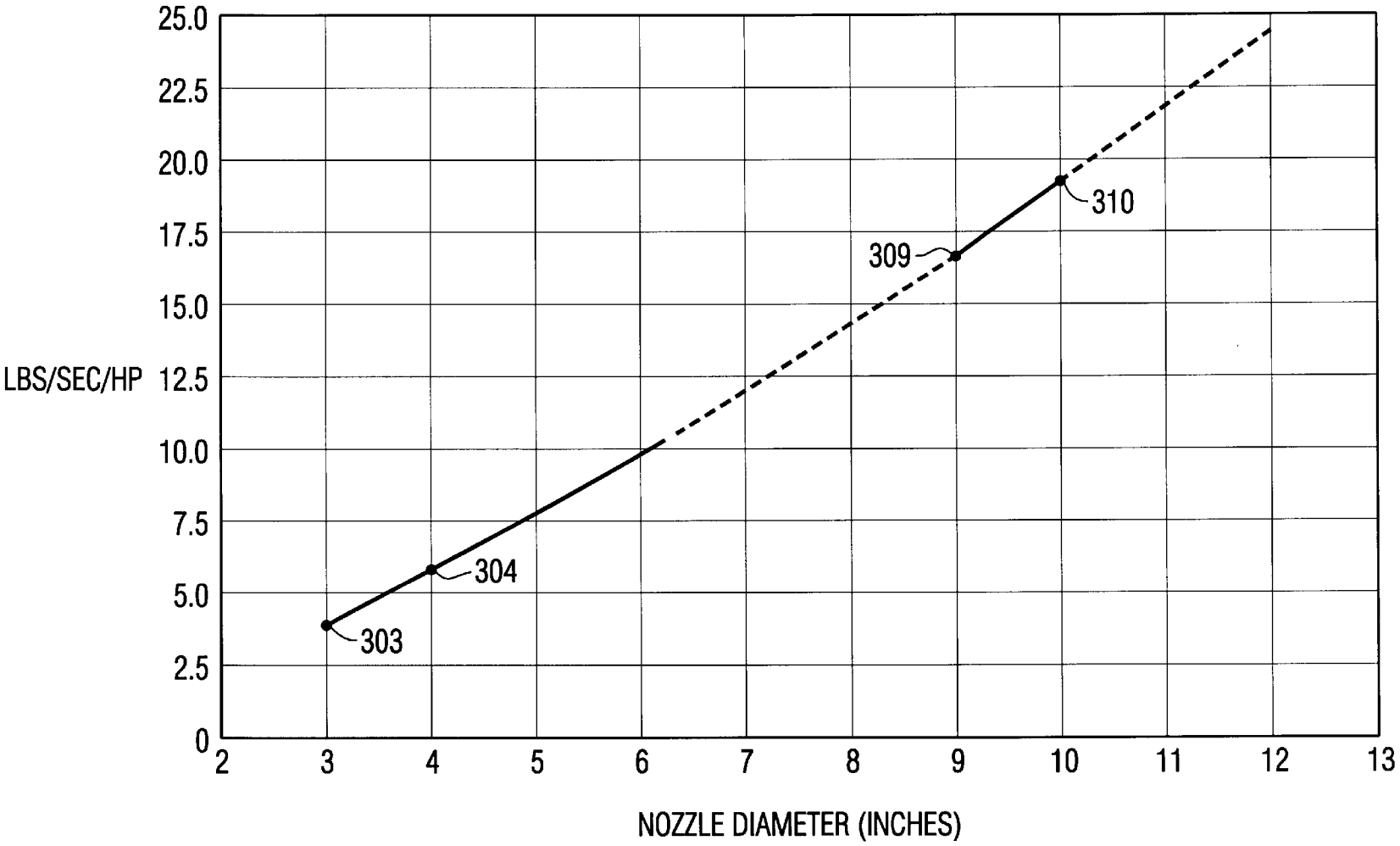
FIG. 11 is a graphical representation of the flow rate per horsepower as a function of nozzle diameter.

FIG. 11 is a graphical representation of the relationship between the nozzle diameter, which is analogous to the outlet opening 122, and the resulting flow rate for each horsepower of the engine 60. The flow rate per horsepower, expressed as pounds per second per horsepower, increases as shown with an increase in the nozzle diameter. Propulsion systems known to those skilled in the art typically use nozzles that are in the range of three to six inches in diameter, two of which are identified by reference numerals 303 and 304 in FIG. 11. These result in flow rates per horsepower of approximately four to ten pounds of water per second per horsepower of the engine 60. The present invention, on the other hand, uses an outlet opening 122 which is approximately nine inches in diameter. The simulated results of various embodiments of the present invention, which utilize outlet openings having diameters of nine inches and ten inches respectively, are identified by reference numerals 309 and 310 in FIG. 11. These openings result in flow rates of water per horsepower in excess of sixteen and, in the case of the ten inch diameter nozzle, in excess of eighteen pounds per second per horsepower. With these significantly increased flow rates, the maximum speed and rate of acceleration of the propulsion system are significantly enhanced.

Figure 12:
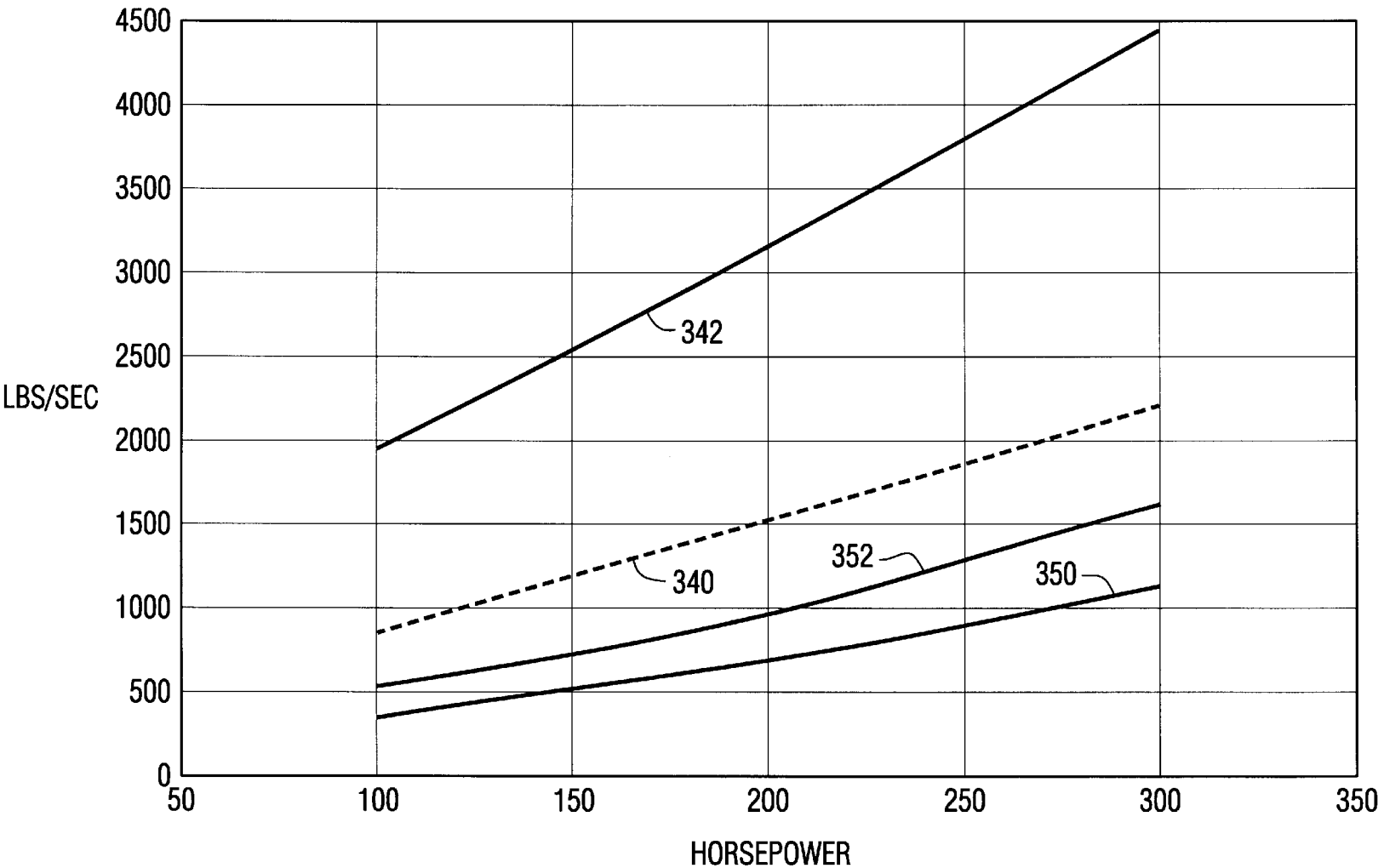
FIG. 12 is a graphical representation of the present invention and a conventional jet pump, showing the flow rate for various horsepower ratings.

As compared to the graphic in FIG. 11, where the rate of flow per horsepower is shown as a function of nozzle diameter, the graphic is FIG. 12 shows the flow rate in pounds per second as a function of horsepower. In FIG. 12, line 342 represents the present invention with a 10% convergence at the outlet opening. In other words, the diameter of the outlet opening is approximately 90% of the effective diameter I of the impeller. Line 340, on the other hand, represents an embodiment of the present invention which has a 30% convergence from the impeller diameter to the diameter of the outlet opening. Lines 350 and 352 represent known jet pumps with convergences of 58% and 42%, respectively. With respect to line 350 in FIG. 12, the nozzle used with the 100 horsepower engine was approximately 3.5 inches while the nozzle used with the 300 horsepower engine was slightly greater than 4.5 inches. Similarly, with respect to line 352, the nozzle diameter used in conjunction with the 300 horsepower engine was slightly greater than 6 inches in diameter.

With continued reference to FIG. 12, a 7.7 inch diameter nozzle was used in conjunction with the 300 horsepower engine for line 340 while a nozzle of approximately 5 inches in diameter is used with the 100 horsepower engine. With respect to line 342, the 100 horsepower engine was used in conjunction with a 9 inch diameter nozzle, the 200 horsepower engine was used with a 10.8 inch diameter nozzle, and the 300 horsepower engine was used with a nozzle slightly greater than 12.5 inches in diameter. It should be understood that the precise size of the nozzle diameter if a function of the horsepower rating of the engine and the design goals for the jet pump. It should further be understood that the examples given above, whether derived empirically or through simulation, are provided for the purpose of illustrating particularly preferred embodiments of the present invention and certain jet pumps known to those skilled in the art so that the capabilities of the devices can be compared. These specific sizes are not limiting to the present invention, other than the need for sufficient inlet size and outlet opening size for the desired amount of water flow measured in pounds per second per horsepower.

The range of performance for the present invention is depicted between a lower level 340 and an upper level 342. The typical performance for known jet drive systems is represented between lower limit 350 and upper limit 352. As can be seen, the flow rate through a pump made in accordance with the present invention significantly exceeds known prior art jet drives. The improved capabilities illustrated in FIG. 12 result in improved acceleration and increased maximum speeds for a boat equipped with the present invention and appropriately sized inlets and outlets.

Figure 13:
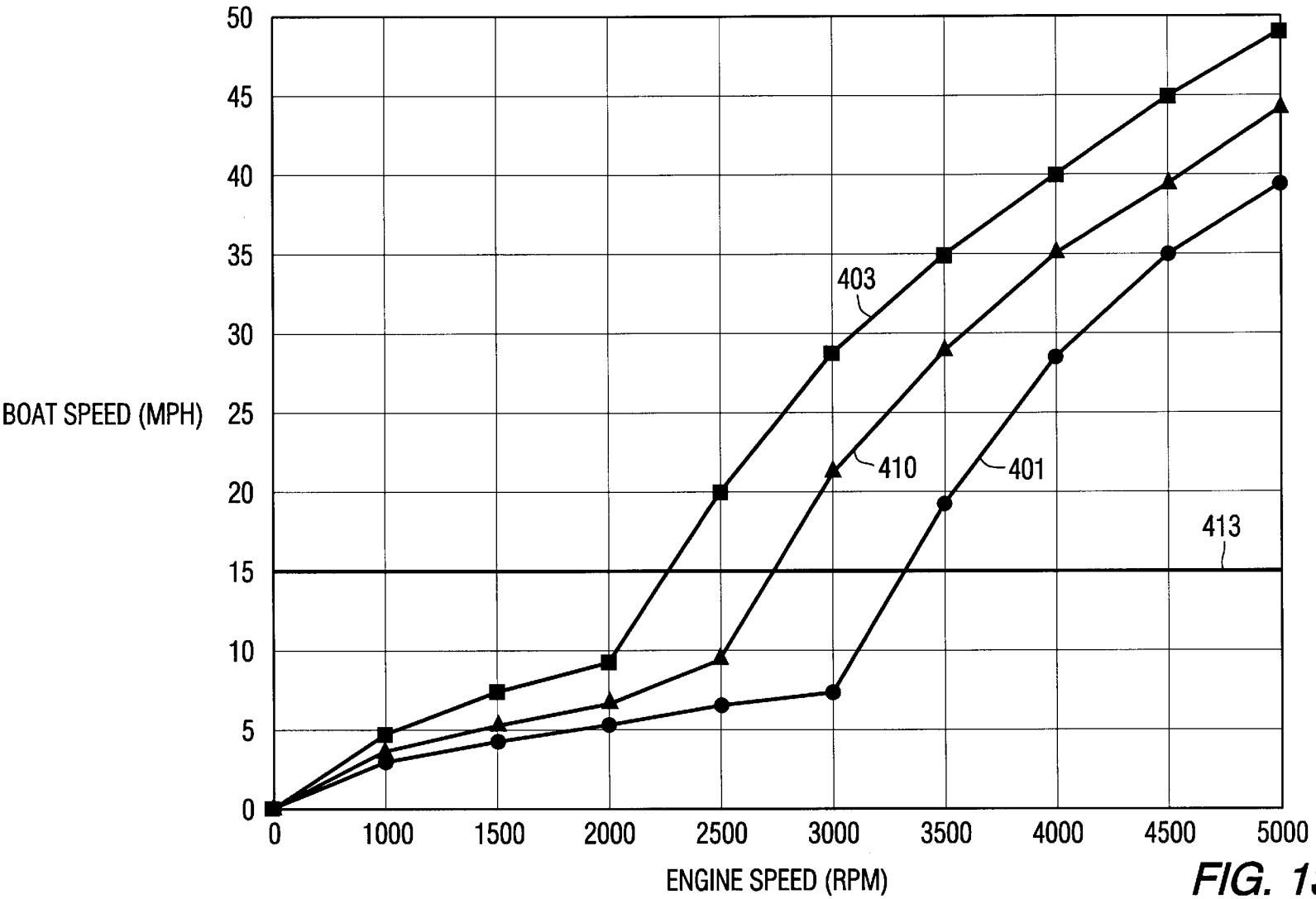
FIG. 13 is a graphical representation of boat speed vs. engine speed for a conventional jet pump, outboard motor, and the present invention.

FIG. 13 shows simulated test results for three propulsion systems. Line 401 shows the boat speed, as a function of engine speed, for a known jet pump equipped with a 90 horsepower engine. Line 403 shows the same relationship for an outboard motor with a 90 horsepower engine. The corresponding results for the present invention are shown in FIG. 13 and represented by line 410. As can be seen, the present invention significantly outperforms the known jet propulsion system and approaches the performance of a 90 horsepower outboard engine. Line 413 in FIG. 13 represents the planing speed of the boat. Comparing the two jet pump propulsion systems, the present invention and the prior art jet pump, it can be seen that the present invention reaches planing speed 413 at approximately 2750 RPM engine speed while the known jet pump does not reach planing speed of 15 miles per hour until the engine is operated at approximately 3300 RPM.

Several different criteria can be used to distinguish the present invention from jet pumps known in the prior art. These criteria, taken individually or in combination with each other, provide a significant improvement in the operation of the jet pump. One characteristic of the present invention is that the outlet opening 122, as described above in conjunction with FIG. 5, is relatively large in comparison to the effective diameter of the impeller 16. In addition, in certain applications of the present invention, the outlet diameter is at least 70% of the impeller effective diameter and in certain applications it is much larger. For reasons relating to the performance of the jet drive, the diameter of the outlet opening is not actually made equal to the effective diameter I of the impeller. A slight reduction in size is intentionally provided at the outlet opening. Another characteristic of the present invention is that its inlet opening, measured from a leading edge to a trailing edge of the opening, is at least twice the magnitude of the effective impeller diameter I. In addition, the effective cross-sectional area of the inlet opening diverges from the leading edge to a transition point at or in front of the impeller. From this transition point to the outlet opening, the effective cross-section converges and the impeller is typically disposed within the region of convergence.

The diverging and converging characteristics of the present invention combine to result in a mass flow rate per horsepower that far exceeds jet drives known to those skilled in the art. These results are shown graphically in FIG. 11 with the mass flow rate per horsepower for the present invention exceeding the prior art by a factor of one and a half or greater. It should be understood that the provision of an enlarged inlet opening, by itself, is not the only contributing factor to the success of the present invention. The enlarged outlet opening also reduces the resistance of the structure to the flow of water through the pump.

The provision of a neutral gear results in a significant improvement in the steering capabilities of the system. When in neutral, a speeding boat is steerable even though the impeller is not being directly driven by the engine. The flow of water through the pump continues after the impeller is disconnected from the engine. One reason for this result is that the larger inlet opening allows the water to more easily continue to flow through the pump in response to movement of the boat relative to the water. Another reason is that the present invention has no bucket to inhibit water flow during deceleration. Known systems, which incorporate inlet openings and outlet openings which result in higher resistance to water flow and buckets, discourage the continued flow of water through the pump when the engine is throttled down in speed. This continued movement of water through the pump allows the tubular rudder to be used to steer the boat when the transmission is in a neutral position and the boat has forward motion.

A comparison of FIGS. 2 and 7 clearly show that the transition of the inlet opening, from the leading edge 140 to the impeller location, is much more gradual and more gently sloped in the present invention than in the prior art illustrated in FIG. 2. In addition, the rise of the water as it enters the inlet opening 120 is significantly less because of the configuration of the pump. As a result, the engine 60 is required to perform less work in the task of raising the water as it flows through the pump.

Comparing FIGS. 2 and 7, it can also be seen that the overall structure of the marine propulsion system of the present invention changes the relative angle between the impeller shaft, represented by dashed line 500 in FIG. 7, and the bottom of the boat represented by dashed line 200. This change is not only in magnitude, but in direction. Comparing angle B in FIG. 7 to angle A in FIG. 2, it can be seen that the prior art drive shaft 56 tilts downward in the aft direction while the centerline 500 of the impeller shaft in FIG. 7 tilts upward in the aft direction. For reasons known to those skilled in the art, a marine propulsion system resulting in angle B of FIG. 7 is advantageous to the marine propulsion system resulting in angle A in FIG. 2.

Although many different sets of component sizes are within the scope of the present invention, certain prototypes were developed and certain simulations were used to test the concepts of the present invention. Dimension I, which is the effective diameter of the impeller, was 10 inches and the outlet opening 122 was 9 inches in diameter. The transition point D4 was approximately 11 inches. In the prototypes and simulations, the length L was approximately 40 to 51 inches, and dimension X was approximately 4 to 8 inches. Therefore, from the leading edge 140 of the inlet opening, the opening diverges to a dimension of approximately 11 inches at the transition point prior to converging to the outlet opening 122. The impeller is located in the region of convergence aft of the transition point.

Although the present invention has been described in significant detail and illustrated with particular specificity to show two embodiments, it should be understood that alternative embodiments are also within the scope of the present invention.

I claim:

1. A marine propulsion system, comprising:

a pump having an inlet opening and an outlet opening;

an impeller disposed within said pump and attached to a drive shaft, said impeller having at least one blade attached thereto and being rotatable about a central axis of said drive shaft to cause water to flow through said pump from said inlet opening to said outlet opening and provide a propulsive force on said marine propulsion system, said impeller having an effective diameter, said outlet opening having a diameter with a magnitude at least 70% the magnitude of the effective diameter of said impeller and less than 98% of said effective diameter of said impeller, said inlet opening having an effective cross sectional area that diverges from a point at a leading edge of said inlet opening to a transition point between said leading edge of said inlet opening and said impeller, said inlet opening having an effective cross sectional area that converges from said transition point to said impeller;

a tubular rudder disposed proximate said outlet opening to provide a steering capability by directing said water in a selectable direction as it flows through said pump in response to rotation of said impeller; and an engine having an output shaft which is rotatable in response to operation of said engine, said output shaft being connectable in torque transmitting relation with said drive shaft.

2. The propulsion system of claim 1, further comprising:

a transmission connected between said output shaft and said drive shaft.

3. The propulsion system of claim 2, wherein:

said transmission comprises at least one forward gear and a neutral gear position.

4. The propulsion system of claim 2, wherein:

said transmission comprises a first gear selection to rotate said drive shaft in a first rotational direction and a second gear selection to rotate said drive shaft in a second rotational direction in response to a manual selection.

5. The propulsion system of claim 2, wherein:

said output shaft and said drive shaft are associated in a V-shaped arrangement with said transmission disposed therebetween.

6. The propulsion system of claim 2, wherein:

said transmission is disposed within said pump and proximate a centerline of said drive shaft.

7. The propulsion system of claim 1, wherein:

said outlet opening has a diameter with a magnitude at least 80% the magnitude of the effective diameter of said blade.

8. The propulsion system of claim 7, wherein:

said outlet opening has a diameter with a magnitude at least 85% the magnitude of the effective diameter of said blade.

9. The propulsion system of claim 8, wherein:

said outlet opening has a diameter with a magnitude at least 90% the magnitude of the effective diameter of said blade.

10. The propulsion system of claim 1, wherein:

a ratio of the mass flow rate of water, in pounds per second per horsepower, through said pump to the horsepower of said engine is at least 10.0.

11. The propulsion system of claim 10, wherein:

said ratio of the mass flow rate of water, in pounds per second, through said pump to the horsepower of said engine is at least 15.0.

12. The propulsion system of claim 11, wherein:

said ratio of the mass flow rate of water, in pounds per second, through said pump to the horsepower of said engine is at least 18.0.

13. The propulsion system of claim 1, wherein:

a length of said opening, measured along a line which is parallel to its direction of travel from a leading edge of said opening to said impeller, has a magnitude which is at least three times the magnitude of said effective diameter of said impeller.

14. The propulsion system of claim 13, wherein:

a length of said opening, measured along a line which is parallel to its direction of travel from a leading edge of said opening to said impeller, has a magnitude which is at least four times the magnitude of said effective diameter of said impeller.

15. A marine propulsion system, comprising:

a pump having an inlet opening and an outlet opening;

an impeller disposed within said pump and attached to a drive shaft, said impeller having at least one blade attached thereto and being rotatable about a central axis of said drive shaft to cause water to flow through said pump from said inlet opening to said outlet opening and provide a propulsive force on said marine propulsion system, said impeller having an effective diameter, said outlet opening having a diameter with a magnitude at least 70% the magnitude of the effective diameter of said impeller and less than 98% of said effective diameter of said impeller, said inlet opening having an effective cross sectional area that diverges from a point at a leading edge of said inlet opening to a transition point between said leading edge of said inlet opening and said impeller, said inlet opening having an effective cross sectional area that converges from said transition point to said impeller;

a tubular rudder disposed proximate said outlet opening to provide a steering capability by directing said water in a selectable direction as it flows through said pump in response to rotation of said impeller;

an engine having an output shaft which is rotatable in response to operation of said engine, said output shaft being connectable in torque transmitting relation with said drive shaft; and a transmission connected between said output shaft and said drive shaft.

16. The propulsion system of claim 15, wherein:

said transmission comprises at least on e forward gear and a neutral gear position.

17. The propulsion system of claim 16, wherein:

a ratio of the mass flow rate of water, in pounds per second per horsepower, through said pump to the horsepower of said engine is at least 10.0.

18. The propulsion system of claim 17, wherein:

a length of said opening, measured along a line which is parallel to its direction of travel from a leading edge of said opening to said impeller, has a magnitude which is at least three times the magnitude of said effective diameter of said impeller.

19. The propulsion system of claim 18, wherein:

a length of said opening, measured along a line which is parallel to its direction of travel from a leading edge of said opening to said impeller, has a magnitude which is at least four times the magnitude of said effective diameter of said impeller.

20. A marine propulsion system, comprising:

a pump having an inlet opening and an outlet opening;

an impeller disposed within said pump and attached to a drive shaft, said impeller having at least one blade attached thereto and being rotatable about a central axis of said drive shaft to cause water to flow through said pump from said inlet opening to said outlet opening and provide a propulsive force on said marine propulsion system, said impeller having an effective diameter, said outlet opening having a diameter with a magnitude at least 70% the magnitude of the effective diameter of said impeller and less than 96% of said effective diameter of said impeller, said inlet opening having an effective cross sectional area that diverges from a point at a leading edge of said inlet opening to a transition point between said leading edge of said inlet opening and said impeller, said inlet opening having an effective cross sectional area that converges from said transition point to said impeller, a ratio of the mass flow rate of water, in pounds per second per horsepower, through said pump to the horsepower of said engine is at least 10.0, a length of said opening, measured along a line which is parallel to its direction of travel from a leading edge of said opening to said impeller, having a magnitude which is at least four times the magnitude of said effective diameter of said impeller;

a tubular rudder disposed proximate said outlet opening to provide a steering capability by directing said water in a selectable direction as it flows through said pump in response to rotation of said impeller;

an engine having an output shaft which is rotatable in response to operation of said engine, said output shaft being connectable in torque transmitting relation with said drive shaft; and a transmission connected between said output shaft and said drive shaft, said transmission comprising at least one forward gear and a neutral gear position.

* * * * *